US006171075B1

(12) United States Patent
Münzenmaier et al.

(10) Patent No.: US 6,171,075 B1
(45) Date of Patent: Jan. 9, 2001

(54) PROCESS AND DEVICE FOR CONTROLLING A TWO-CYLINDER THICK MEDIUM PUMP

(75) Inventors: Werner Münzenmaier; Christof Schnitzler, both of Nürtingen (DE)

(73) Assignee: Putzmeister AG (DE)

( * ) Notice: Under 35 U.S.C. 154(b), the term of this patent shall be extended for 0 days.

(21) Appl. No.: 09/068,705

(22) PCT Filed: Aug. 31, 1996

(86) PCT No.: PCT/EP96/03830

§ 371 Date: Sep. 25, 1998

§ 102(e) Date: Sep. 25, 1998

(87) PCT Pub. No.: WO97/18395

PCT Pub. Date: May 22, 1997

(30) Foreign Application Priority Data

Nov. 13, 1995 (DE) ..... 195 42 258

(51) Int. Cl.[7] ..... F04B 15/02; F04B 9/117

(52) U.S. Cl. ..... 417/342; 417/344; 417/345

(58) Field of Search ..... 417/337, 339, 417/342, 344, 345, 346, 390, 900

(56) References Cited

U.S. PATENT DOCUMENTS 5,238,371 * 8/1993 Benckert ..... 417/345
5,316,453 * 5/1994 Schwing ..... 417/516
5,344,290 * 9/1994 Benckert ..... 417/432
5,458,470 10/1995 Mannhart et al. .

FOREIGN PATENT DOCUMENTS 32 43 576 A1 5/1984 (DE) .
38 40 892 A1 6/1990 (DE) .

OTHER PUBLICATIONS

JP 57–102579 A. In: Patents Abstracts of Japan, M–161, Oct. 5, 1982, vol. 6, No. 196.

* cited by examiner

*Primary Examiner*—Henry C. Yuen
*Assistant Examiner*—Arnold Castro
(74) *Attorney, Agent, or Firm*—Pendorf & Cutliff

(57) ABSTRACT

The invention relates to a sequential control system for two-cylinder thick medium pumps whose delivery cylinders (1, 1') are actuated hydraulically by two drive cylinders (5, 5') in opposing cycles. A pipe shunt (3) is provided inside a material feed container and is connected at the inlet side alternatively to the apertures (2, 2') of the delivery cylinders (1, 1') and at the outlet side to a pump line (4). The drive cylinders (5, 5') are each connected at one end to a different connection pint of a reversing pump (6) to form a closed hydraulic circuit (11, 11') and at their outer ends via an oscillating oil line (12) hydraulically to one another. To effect switching of the pipe shunt (3), pressure oil is taken off directly from the hydraulic lines (11, 11') leading from the reversing pump (6) to the drive cylinders (5, 5'). To ensure smooth switching of the pipe shunt (3) without any malfunctioning in delivery operation, the invention proposes that the reversing pump (6) should be switched by reversing the flow and the pipe shunt (3) if the pistons (8, 8') of the drive cylinder (5, 5') reach their end position; and the oscillating oil line (12) should be closed off at least for time during switching of the reversing pump (6).

11 Claims, 3 Drawing Sheets

PROCESS AND DEVICE FOR CONTROLLING A TWO-CYLINDER THICK MEDIUM PUMP

BACKGROUND OF THE INVENTION

1. Field of the Invention

The invention is related to a method and a device for controlling a thick matter pump having two conveying cylinders which are alternatingly operable by means of at least one hydraulic reversing pump and hydraulic drive cylinders driven thereby and which open into a material feed container with front face openings, and having a hydraulically actuatable pipe shunt which is disposed within the material feed container, the inlet side of which pipe shunt is adapted to be alternatingly coupled to the openings of the conveying cylinders, thereby vacating the respective other opening, and the outlet side of which pipe shunt is adapted to be connected to a conveying line, wherein a switching operation of the pipe shunt is effected upon ending a feed stroke in the conveying cylinders, wherein the drive cylinders are hydraulically connected at their one end to a respective port of the reversing pump under formation of a closed hydraulic circuit and at their other end to each other by way of an oscillating oil line, and wherein pressure oil is taken off directly from hydraulic lines which lead from the reversing pump to the drive cylinders in order to effect the switching of the pipe shunt.

2. Description of the Related Art

A method for controlling a two-cylinder thick matter pump of this kind is known (EP-B 0 446 206), wherein at the end of each pressure stroke in the conveying cylinders a switching process of the pipe shunt is effected, in which the pistons of the drive cylinders are held in their end position under the action of the pressure created by the reversing pump in the main circuit and the feed direction of the reversing pump is reversed only after finishing the switching process of the pipe shunt. When triggering the switching process of the pipe shunt, the feed quantity and/or the feed pressure of the reversing pump may be varied while keeping the feed direction constant. The switching of the pipe shunt is effected solely by means of a directional valve which is switched over while the reversing pump is still operated in the previous feed direction. This results in an undesireably hard start-up during the switching of the pipe shunt.

SUMMARY OF THE INVENTION

Based on this it is the object of the invention to develop a method and a device for controlling a thick matter pump of the type described above, in which a soft start-up during the switching of the pipe shunt is achieved using a circuit as simple as possible.

With the measures according to the invention it is achieved that the drive cylinders and the pipe shunt switching members operate in a single-circuit system, it still being possible to subject the drive cylinders to pressure oil in the free flow. This means that for the switching of the pipe shunt pressure oil is directly taken from a main circuit leading from the reversing pump to the drive cylinders. A particular aspect of the invention is that the pipe shunt is controlled with the aid of the switching reversing pump. This results in a soft start-up.

In order to prevent an unwanted reverse feed into the material feed container during the switching of the pipe shunt, the reversing pump is switched under reversal of through flow and reversing of the pipe shunt when the pistons of the drive cylinders reach their end positions, and the oscillating oil line is closed off at least momentarily during the switching of the reversing pump. Expediently, the oscillating oil line is closed off when the switching reversing pump is passing through a neutral position or with a time delay thereafter until the pipe shunt is fully switched. In principle it is also possible to open the closed oscillating oil line before the pipe shunt has been fully switched. In this latter case, the material to be conveyed is precompressed somewhat within the conveying cylinder, before the actual onset of the conveying process through the pipe shunt and the conveying line.

According to a second variant of the invention at least two reversing pumps connected in parallel are provided, which are switched under flow reversal when pistons of the drive cylinders reach their end positions, wherein during the switching at least one of the reversing pumps is closed off with respect to the drive cylinders under switching of the pipe shunt and at least one further reversing pump is closed off with respect to actuating members of the pipe shunt under switching of the drive cylinders. In order to synchronize the switching of the pipe shunt and the starting of the material conveying while precompressing the material in the conveying cylinder, the reversing pump which is closed off with respect to the pipe shunt can be switched time-delayed and/or choked relative to the reversing pump which is closed off with respect to the drive cylinders.

In both embodiments it can be of advantage when the feed quantity and/or the feed pressure of the reversing pump is varied during the switching of the pipe shunt as compared to the conveying operation. Furthermore, when feed quantity is modulated during the switching of the pipe shunt, for example starting with a small quantity (slow), then changing to a larger quatity (fast) and back again to a small quantity (slow), an especially soft yet quick switching can be achieved.

In a device for implementing the method according to the invention, the flow reversal of the reversing pump is effected in a first variant of the invention by means of the end position signals of the drive cylinders, and a stop valve which is adapted to be controlled by the end position signals of the drive cylinders and which can be controlled time-delayed, if needed, is disposed in the oscillating oil line.

In the case of the second variant of the invention at least two reversing pumps are disposed in the hydraulic lines of the hydraulic circuit, which are connected in parallel and which are adapted to be switched by means of the end position signals of the drive cylinders, of which at least one reversing pump is connected directly to the drive cylinders and at least one further reversing pump is connected indirectly to the drive cylinders by way of stop valves which each are adapted to be controlled by the end position signals, and the actuating members of the pipe shunt are connected to the hydraulic lines of the hydraulic circuit in a region between the first reversing pump and the corresponding stop valves.

BRIEF DESCRIPTION OF THE DRAWINGS

In the following the invention is further described with reference to embodiments schematically shown in the drawing, in which.

DETAILED DESCRIPTION OF THE INVENTION

Figure 1:
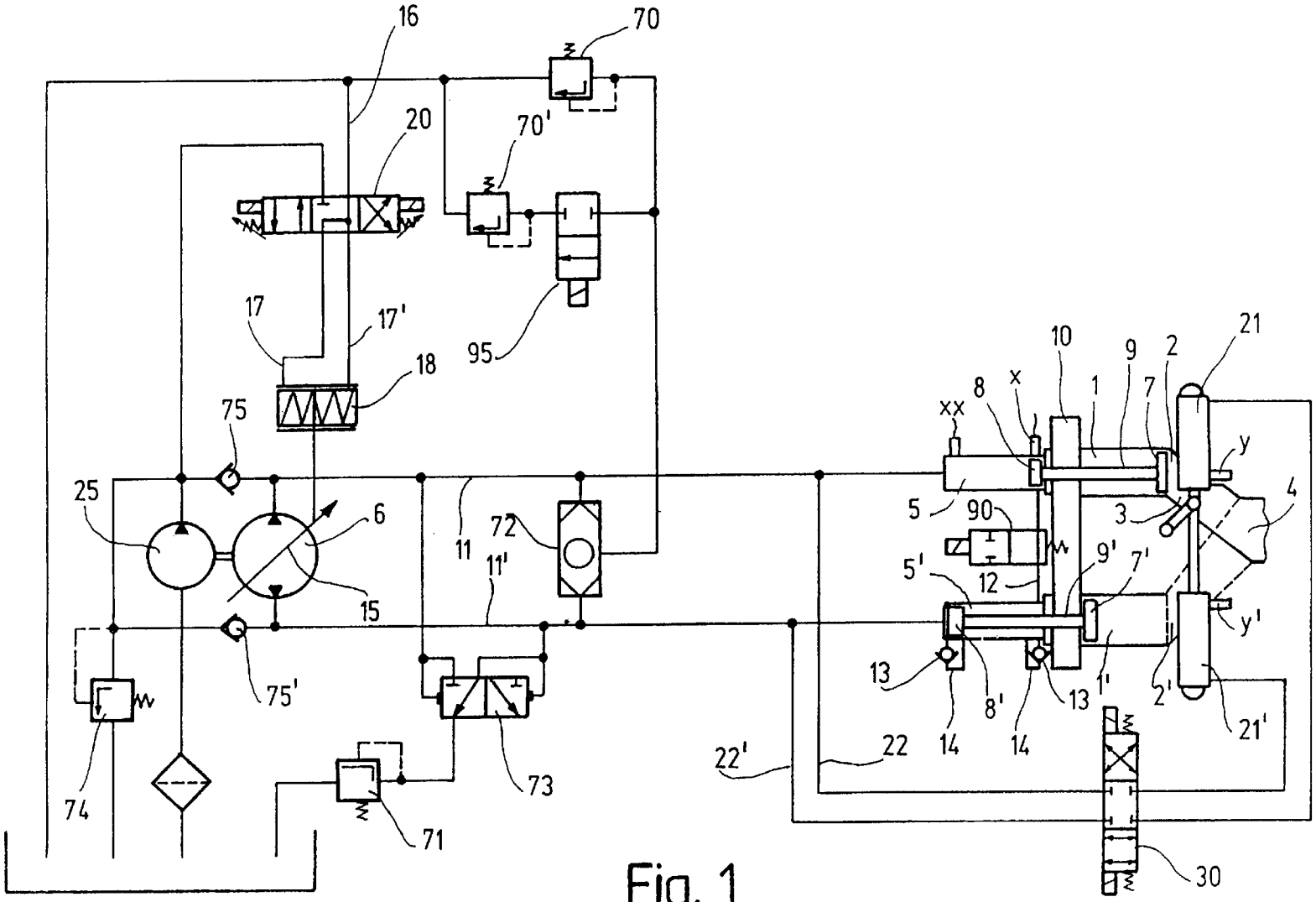
FIG. 1 shows a circuit diagramm of a free-flow servo control for drive cylinders and pipe shunt cylinders in a single circuit arrangement with a reversing pump.

The control devices shown in the drawing are intended for a thick matter pump which has two conveying cylinders 1, 1', the front face openings 2, 2' of which open into a material feed container (not shown) and which are adapted to be alternatingly coupled to a feed line 4 during the pressure stroke by means of a pipe shunt 3. The conveying cylinders 1, 1' are driven in a push-pull manner by hydraulic drive cylinders 5, 5' and by reversing hydraulic pumps 6 and 6' (FIGS. 2 and 3) which are designed to be swash-plate axial piston pumps in the embodiments shown. To this end the conveying pistons 7, 7' are connected to the drive cylinders 5, 5' by means of a mutual piston rod 9, 9'. Located between the conveying cylinders 1, 1' and the drive cylinders 5, 5' there is a water container 10, through which the piston rods 9, 9' extend.

In the embodiments shown, the bottom sides of the drive cylinders 5, 5' are subjected to pressure oil by way of the hydraulic lines 11, 11' of the main circuit with the aid of the reversing pump 6 (FIG. 1) or reversing pumps 6, 6' (FIGS. 2 and 3), and are hydraulically coupled to each other at the rod-side end by means of an oscillating oil line 12. For the purpose of stroke correction a pressure compensation line 14 is disposed at each end of the drive cylinder 5', which comprises a check valve 13 and which bridges the corresponding drive piston 8' in its end positions.

The direction of movement of the drive pistons 8, 8' and therefore the conveying pistons 7, 7' is reversed in that the swashplates 15, 15' of the reversing pumps 6, 6' switch through their neutral position, released by a switching signal, and thereby reverse the feed direction of the pressure oil in the hydraulic lines 11, 11' of the main circuit. The feed quantity of the reversing pumps 6, 6' is determined for a given drive speed by the pivot angle of their swash-plate 15, 15'. The swash-plate angle and therefore the feed quantity can be adjusted in proportion to a control pressure which actuates the setting cylinder 18 (FIG. 1) or setting cylinders 18, 18' (FIGS. 2 and 3) by way of the lines 17, 17' and the proportional valve 20 located in the corresponding circuit line. The high pressure level can be changed according to the switching states of the thick matter pump by way of the stop valve 95 and the two pressure control valves 70, 70', while a pressure regulator 71 is provided for setting the low pressure level. Their control inputs can be connected to the lines 11, 11', which conduct a high pressure and a low pressure, respectively, of the main circuit by the changeover valve 72 (FIG. 1) or the changeover valves 72, 72' (FIGS. 2 and 3) on the one hand and a diectional control valve 73 which is formed to be a flush valve on the other hand.

The auxiliary pump 25 charges the closed main circuit by way of the check valves 75, 75' and is protected by the pressure control valve 74.

The switching of the pipe shunt 3 is effected by means of the hydraulic cylinders 21, 21', which are preferably formed to be plunger cylinders, which are directly subjected to the pressure oil supplied by the reversing pump 6 by way of control lines 22, 22' which branch of from the hydraulic lines 11, 11' of the main circuit and by the changeover valve 30. The changeover valve 30 serves exclusively to externally adjust the conveying operation (normal operation) or the reverse conveying operation, in which material located in the conveying line is pumped back into the material feed container.

The actuation of the main control valve 20 which determines the direction of feed of the reversing pumps 6, 6' is effected by the electrically measured end position signals x and xx of the drive cylinder 5.

In the embodiment shown in FIG. 1, only one reversing pump 6 is located in the main circuit 11, 11', while a stop valve 90 is additionally located in the osciallating oil circuit 12, which is momentarily brought into its stop position during the switching of the swash plate 15 of the reversing pump 6 by means of the end position signals x, xx. During the switching of the pipe shunt the stop valve 95 can be actuated by means of the end position signals x, xx, and the high pressure level can be adjusted thereby by means of the pressure control valve 70'. The feed quantity of the reversing pump 6 may additionally be modulated by means of the proportional valve 20, for example in order to attain a quick yet soft switching of the pipe shunt. After the pipe shunt has been switched or shortly before, the stop valve 90 is reopened, so that the interrupted conveying process may be continued through the other conveying cylinder after changing the through-flow direction of the reversing pump 6.

Figure 2:
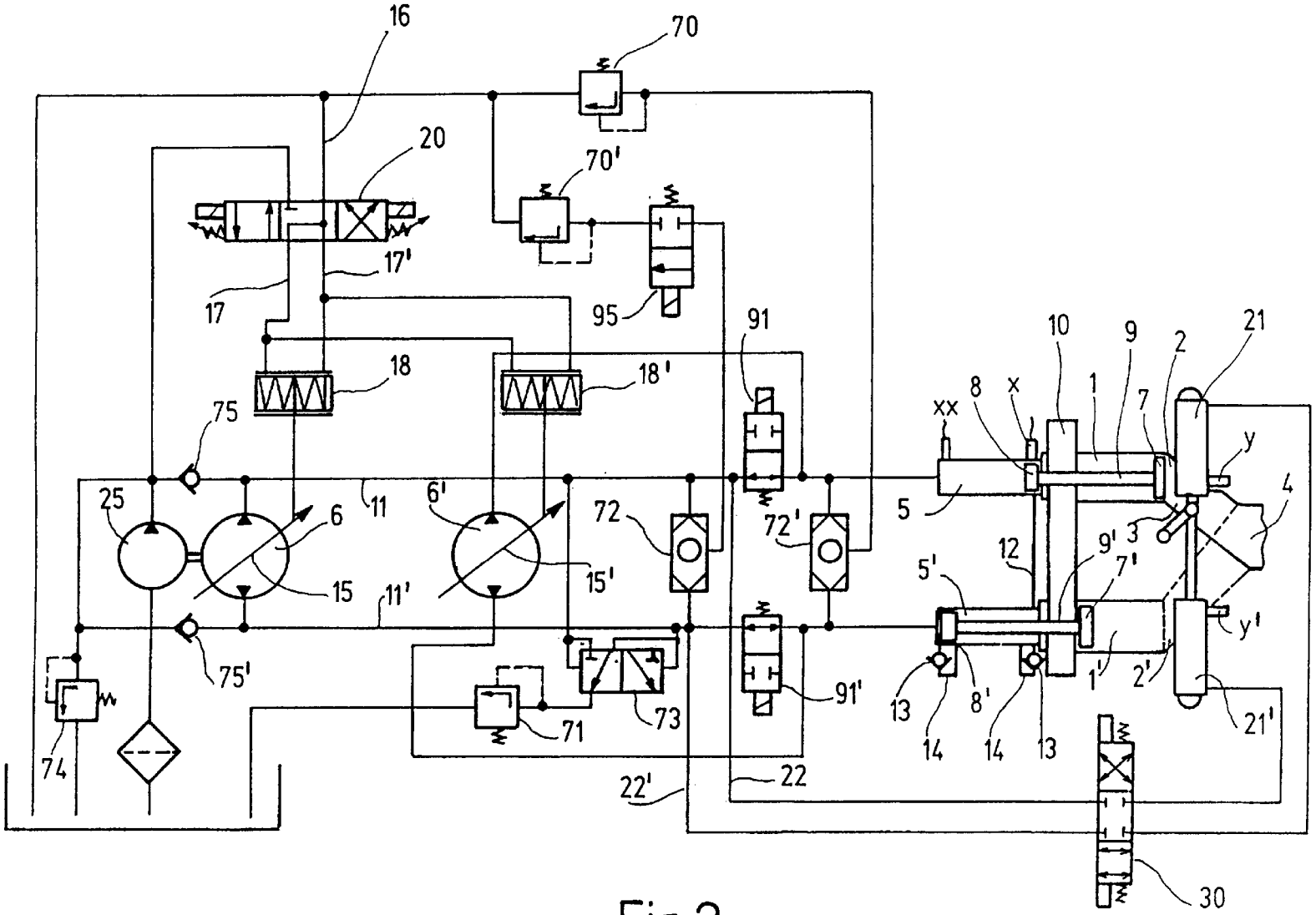
FIG. 2 shows a circuit diagramm of a free-flow servo control having two reversing pumps.
Figure 3:
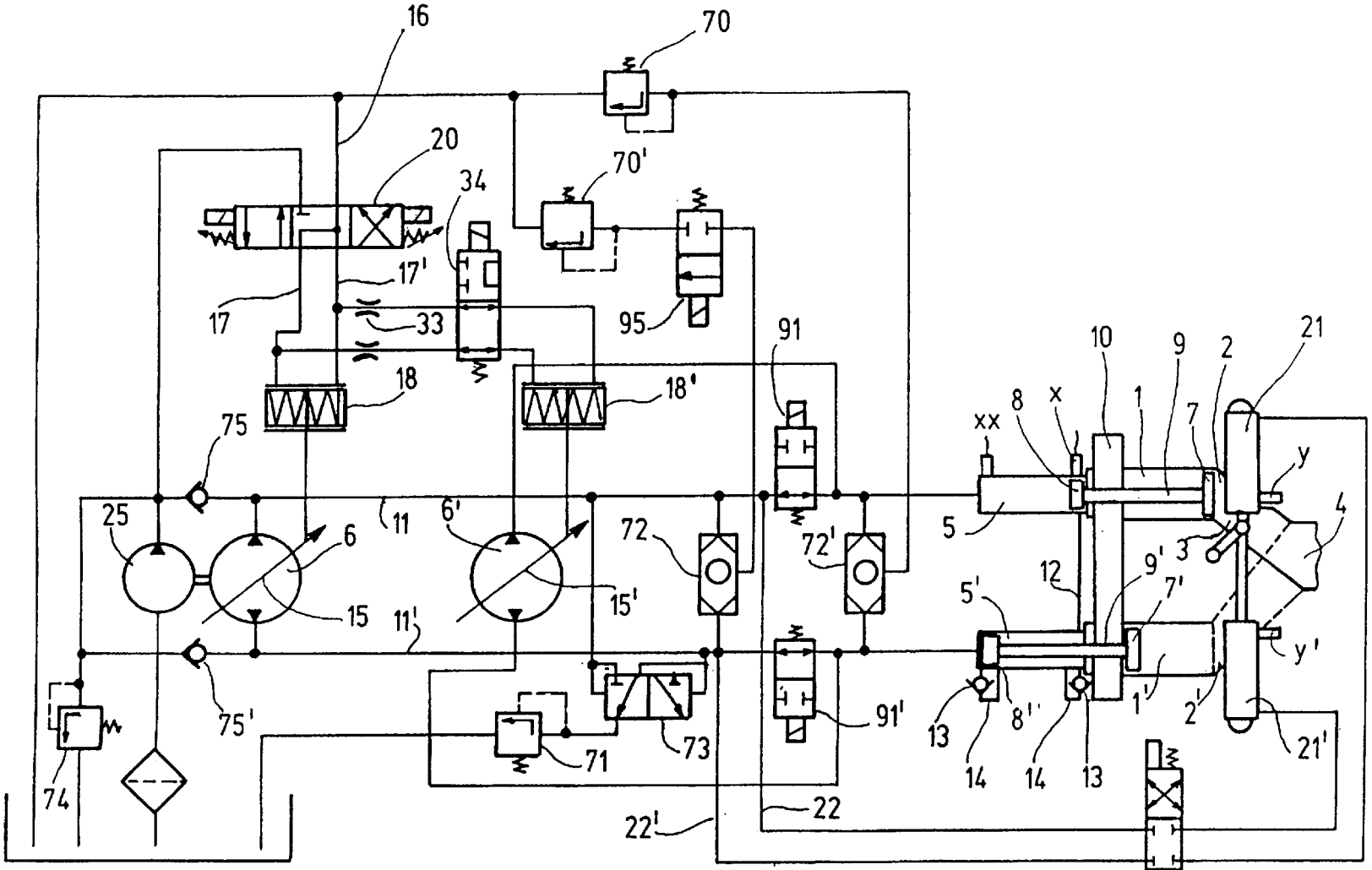
FIG. 3 shows a circuit diagramm of a free-flow servo control having two reversing pumps which is modified with respect to FIG. 2.

In the embodiments shown in FIGS. 2 and 3, two reversing pumps 6, 6' which are switched in parallel are disposed in the main circuit, which are separated from each other by stop valves 91, 91', one each of which is disposed in the hydraulic lines 11, 11'. The stop valves 91, 91' are closed during the switching of the reversing pumps 6, 6', which is triggered by the end position signals x, xx. Since the control lines 22, 22' in the region between the reversing pump 6 and the stop valves 91, 91' are connected to the hydraulic lines 11, 11', the pipe shunt 3 is controlled only by the switching reversing pump 6, while the reversing pump 6', which is closed off with respect to the lines 22, 22', initially alone controls the drive cylinders 5, 5'. The latter leads to a precompression of the material in the conveying cylinder 1, 1' which is filled for the conveying process. If needed, this precompression may be delayed by means of a choke member 33 and/or a stop valve 34 such that the actual conveying process starts only after a complete switching of the pipe shunt 3. After the complete switching of the pipe shunt 3, the stop valves 91, 91' are opened again, so that also the reversing pump 6 subjects in parallel to the reversing pump 6' the conveying cylinders 5, 5' to pressure. The control of the stop valves 91, 91' may, for example, be effected by means of the end position signals y, y' of the pipe shunt cylinders 21, 21'.

In summary the following is to be stated: The invention is related to a follow-up control for two-cylinder thick matter pumps, the conveying cylinders 1, 1' of which are actuated in a push-pull manner by means of two drive cylinders 5, 5', wherein a pipe shunt 3 is disposed within a material feed container, which pipe shunt is alternatingly coupled to the openings 2, 2' of the conveying cylinders 1, 1' on its inlet side and to a conveying line 4 on its outlet side. The drive cylinders 5, 5' are hydraulically connected at their one end to a port of a reversing pump 6, thereby forming a closed hydraulic circuit 11, 11', and at their other end to each other by means of an oscillating oil line 12. In order to switch the pipe shunt 3, pressure oil is taken directly from the hydraulic lines 11, 11' which lead from the reversing pump 6 to the drive cylinders 5, 5'. In order to assure a soft switching of the pipe shunt 3 without malfunctions of the conveying process, it is proposed according to the invention that the reversing pump 6 is switched under reversal of through flow and reversing of the pipe shunt 3 when pistons 8, 8' of the drive cylinders 5, 5' reach their end positions, and that the oscillating oil line 12 is closed off at least momentarily during the switching of the reversing pump 6.

What is claimed is:

1. A method for controlling a thick matter pump, said pump comprising:

a material feed tank;

first and second conveying cylinders (1, 1'), each in fluid communication with a material feed tank and each including a conveying piston (7, 7') for pumping thick matter through the respective conveying cylinder, hydraulic drive cylinders (5, 5'), each of which having a drive piston (8, 8') connected via a piston rod (9, 9') to a conveying piston (7, 7'), each drive cylinder coupled at one end to a respective port of a hydraulic reversing pump (6) and coupled at the other end to each other by way of an oscillating oil line (12) thereby forming a closed hydraulic circuit, the reversing pump driving a respective drive piston through a compression stroke by pumping pressurized fluid to the respective drive cylinder, and a hydraulically operable pipe shunt (3) disposed within the material feed container and adapted to be alternately coupled to the conveying cylinders to receive the thick matter being pumped from the respective conveying cylinder to which it is coupled, and being coupled to a conveying line (4) to direct the flow of thick matter from each conveying cylinder into the conveying line (4), and said method comprising:

actuating the pipe shunt to be decoupled from the first conveying cylinder and coupled to the second conveying cylinder when the drive piston of the first conveying cylinder reaches the end of its compression stroke, reversing the direction of fluid flow through the reversing pump (6) to initiate the compression stroke of the second drive cylinder, including closing off the oscillating oil line (12) at least momentarily during the reversing the direction of fluid flow through the reversing pump (6) and reopening the oscillating oil line (12) at a time between shortly before and after the pipe shunt has been switched, when the drive piston of the second conveying cylinder reaches the end of its compression stroke, actuating the pipe shunt to be decoupled from the second conveying cylinder and coupled to the first conveying cylinder, reversing the direction of fluid flow through the reversing pump (6) to initiate the compression stroke of the first drive cylinder, including closing off the oscillating oil line (12) at least momentarily during the reversing the direction of fluid flow through the reversing pump (6) and reopening the oscillating oil line (12) at a time between shortly before and after the pipe shunt has been switched, wherein pressure oil is taken off directly from hydraulic lines (11, 11') in order to effect the switching of the pipe shunt (3).

2. The method of claim 1, comprising closing off the oscillating oil line (12) until the pipe shunt (3) has been switched.

3. The method of claim 1, comprising opening the oscillating oil line (12) before the pipe shunt (3) is fully switched.

4. The method of claim 1, comprising closing off the oscillating oil line (12) when the switching of the reversing pump (6) is passing through a neutral position or with a time delay thereafter.

5. The method of claim 1, wherein the feed quantity and/or the feed pressure of the reversing pump (6, 6') is varied, preferably reduced, during the switching of the pipe shunt (3) as compared to the conveying operation.

6. The method of claim 5, wherein the feed quantity of the reversing pump is modulated during the switching of the pipe shunt.

7. A method for controlling a thick matter pump, said pump comprising:

a material feed tank;

first and second conveying cylinders (1, 1'), each in fluid communication with a material feed tank and each including a conveying piston (7, 7') for pumping thick matter through the respective conveying cylinder, at least two reversing pumps (6, 6') connected in parallel, hydraulic drive cylinders (5, 5'), each of which having a drive piston (8, 8') connected via a piston rod (9, 9') to a conveying piston (7, 7'), each drive cylinder coupled at one end to at least one port of said hydraulic reversing pumps (6, 6') and coupled at the other end to each other by way of an oscillating oil line (12) thereby forming a closed hydraulic circuit, the reversing pumps driving a respective drive piston through a compression stroke by pumping pressurized fluid to the respective drive cylinder, and a hydraulically operable pipe shunt (3) actuated by actuation members (21), disposed within the material feed tank and adapted to be alternately coupled to the conveying cylinders to receive the thick matter being pumped from the respective conveying cylinder to which it is coupled, and being coupled to a conveying line (4) to direct the flow of thick matter from each conveying cylinder into the conveying line (4), and said method comprising:

actuating the pipe shunt to be decoupled from the first conveying cylinder and coupled to the second conveying cylinder when the drive piston of the first conveying cylinder reaches the end of its compression stroke, reversing the direction of fluid flow through the reversing pumps (6, 6') to initiate the compression stroke of the second drive cylinder, including closing off at least one of the reversing pumps (6) with respect to the drive cylinders (5, 5') during switching of the pipe shunt (3) and closing off at least one further reversing pump (6') with respect to actuating members (21, 21') of the pipe shunt (3) during switching of the drive cylinders (5, 5'), when the drive piston of the second conveying cylinder reaches the end of its compression stroke, actuating the pipe shunt to be decoupled from the second conveying cylinder and coupled to the first conveying cylinder, reversing the direction of fluid flow through the reversing pumps (6, 6') to initiate the compression stroke of the first drive cylinder, including closing off at least one of the reversing pumps (6, 6') with respect to the drive cylinders (5, 5') during switching of the pipe shunt (3) and closing off at least one further reversing pump (6') with respect to actuating members (21, 21') of the pipe shunt (3) during switching of the drive cylinders (5, 5'), wherein pressure oil is taken off directly from hydraulic lines (11, 11') in order to effect the switching of the pipe shunt (3).

8. The method of claim 7, wherein the reversing pump (6') which is closed off with respect to the pipe shunt (3) is switched time-delayed and/or choked relative to the reversing pump (6) which is closed off with respect to the drive cylinders (5, 5').

9. The method of claim 7, wherein the feed quantity and/or the feed pressure of the reversing pump (6, 6') is varied, preferably reduced, during the switching of the pipe shunt (3) as compared to the conveying operation.

10. A thick matter pump comprising:

a material feed container;

two conveying cylinders (1, 1') each having one end opening into said material feed container (2, 2'), and having conveying pistons (7, 7') disposed therein;

a conveying line (4);

a hydraulically actuatable pipe shunt (3) which is disposed within the material feed container, the pipe shunt having an inlet and an outlet, the inlet adapted to being alternatingly coupled to one of the openings (2, 2') of the conveying cylinders (1, 1'), thereby vacating the respective other opening (2', 2), and the outlet side of which pipe shunt connected to said conveying line (4);

two hydraulic drive cylinders (5, 5') with drive pistons (8, 8') for driving said two conveying pistons (7, 7') in said conveying cylinders (1, 1'), respectively;

at least one hydraulic reversing pump (6, 6') for alternatingly operating said two hydraulic drive pistons (8, 8') in said drive cylinders (5, 5') in a push-pull manner, a reversing valve (20) for driving said hydraulic reversing pump (6, 6'), and means for sensing the end positions of pistons (8, 8') of the drive cylinders (5, 5') and creating end position signals (x, xx), wherein said hydraulic drive cylinders (5, 5') are driven in a closed hydraulic circuit, wherein the drive cylinders (5, 5') are hydraulically connected at their one end to a respective port of the reversing pump (6, 6') by means of a hydraulic line (11, 11') of the hydraulic circuit and at their other end to each other by way of an oscillating hydraulic line (12), wherein hydraulic actuating members (21, 21') are provided for driving the pipe shunt (3), each connected to one of the hydraulic lines (11, 11') of the hydraulic circuit by a control line (22, 22'), and wherein the flow reversal of the reversing pump (6) is effected by means of the end position signals (x, xx) of the drive cylinders (5, 5'), and wherein a stop valve (90) adapted to be controlled by the end position signals (x, xx) of the drive cylinders (5, 5') is disposed in the oscillating hydraulic line (12).

11. A thick matter pump comprising:

a material feed container;

two conveying cylinders (1, 1') each having one end opening into said material feed container (2, 2'), and having conveying pistons (7, 7') disposed therein;

a conveying line (4);

a hydraulically actuatable pipe shunt (3) which is disposed within the material feed container, the pipe shunt having an inlet and an outlet, the inlet adapted to being alternatingly coupled to one of the openings (2, 2') of the conveying cylinders (1, 1'), thereby vacating the respective other opening (2', 2), and the outlet side of which pipe shunt connected to said conveying line (4);

two hydraulic drive cylinders (5, 5') with drive pistons (8, 8') for driving said two conveying pistons (7, 7') in said conveying cylinders (1, 1'), respectively;

at least one hydraulic reversing pump (6, 6') for alternatingly operating said two hydraulic drive pistons (8, 8') in said drive cylinders (5, 5') in a push-pull manner, a reversing valve (20) for driving said hydraulic reversing pump (6, 6'), and means for sensing the end positions of pistons (8, 8') of the drive cylinders (5, 5') and creating end position signals (x, xx), wherein said hydraulic drive cylinders (5, 5') are driven in a closed hydraulic circuit, wherein the drive cylinders (5, 5') are hydraulically connected at their one end to a respective port of the reversing pump (6, 6') by means of a hydraulic line (11, 11') of the hydraulic circuit and at their other end to each other by way of an oscillating hydraulic line (12), wherein hydraulic actuating members (21, 21') are provided for driving the pipe shunt (3), each connected to one of the hydraulic lines (11, 11') of the hydraulic circuit by a control line (22, 22'), and wherein at least two reversing pumps (6, 6') are disposed in the hydraulic lines (11, 11') of the hydraulic circuit, which are connected in parallel and which are adapted to be switched by means of the end position signals (x, xx) of the drive cylinders (5, 5'), of which at least one reversing pump (6') is connected directly to the drive cylinders (5, 5') and at least one further reversing pump (6) is connected indirectly to the drive cylinders (5, 5') by way of stop valves (91, 91') which each are adapted to be controlled by the end position signals (x, xx), and wherein the actuating members (21, 21') of the pipe shunt (3) are connected to the hydraulic lines (11, 11') of the hydraulic circuit in a region between the first reversing pump (6) and the corresponding stop valves (91, 91').

* * * * *